US006386277B1

(12) United States Patent
Wattelet et al.

(10) Patent No.: US 6,386,277 B1
(45) Date of Patent: May 14, 2002

(54) HEAT EXCHANGER HEADER CONSTRUCTION

(75) Inventors: Jonathan P. Wattelet, Gurnee, IL (US); Stephen B. Memory, Kenosha, WI (US); Jeffrey A. Logic, Racine, WI (US); Mark G. Voss, Franksville, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/841,645

(22) Filed: Apr. 24, 2001

(51) Int. Cl.[7] ..... F28D 7/16
(52) U.S. Cl. ..... 165/164; 165/175; 62/513
(58) Field of Search ..... 62/513; 165/140, 165/164, 175

(56) References Cited

U.S. PATENT DOCUMENTS 5,242,015 A * 9/1993 Saperstein et al. ..... 165/163
6,185,957 B1 * 2/2001 Voss et al. ..... 62/513

FOREIGN PATENT DOCUMENTS

AT 142147 B1 * 2/1935 ..... 165/164

* cited by examiner

*Primary Examiner*—Allen Flanigan
(74) *Attorney, Agent, or Firm*—Wood, Phillips, VanSanten, Clark & Mortimer

(57) ABSTRACT

A heat exchanger provides simplicity, compactness, and high efficiency through a construction that includes an elongated tube structure comprising three rows of flattened multiport tubing, with a first row of tubing 30 and a third row of tubing 50 sandwiching a second row of tubing 40. The second row of tubing 40 terminates in opposite ends 42,44 on which are received refrigerant fittings 46 and 48 respectively. The first and third rows of tubing 30, 50 each include a run abutting and in heat exchange relation with the tubing 40. Opposing ends 32, 34 of the tubing 30 extend about refrigerant fittings 46 and 48 and are received in refrigerant fittings 36, 38. The tubing 50 includes parts 52 and 54 extending about the refrigerant fittings 46 and 48 and terminating in opposite ends 56, 58. The ends 56, 58 are also in fluid communication with fittings 36, 38.

16 Claims, 2 Drawing Sheets

HEAT EXCHANGER HEADER CONSTRUCTION

FIELD OF THE INVENTION

This invention relates to a headering system for heat exchangers, and more particularly, to a headering system for a suction line heat exchanger for use in refrigeration systems.

BACKGROUND OF THE INVENTION

As is well known, discharge of refrigerants into the atmosphere is considered to be a major cause of the degradation of the ozone layer. While refrigerants such as HFC's are certainly more environmentally friendly than refrigerants such as CFC's which they replaced, they nonetheless are undesirable in that they may contribute to the so-called greenhouse effect.

Both CFC's and HFC's have been used largely in vehicular applications where weight and bulk are substantial concerns. If a heat exchanger in an automotive air conditioning system is too heavy, fuel economy of the vehicle will suffer. Similarly, if it is too bulky, not only may a weight penalty be involved, but the size of the heat exchanger may inhibit the designer of the vehicle in achieving an aerodynamically "slippery" design that would also improve fuel economy.

Much refrigerant leakage to the atmosphere occurs from vehicular air-conditioning systems because the compressor cannot be hermetically sealed as in stationary systems, typically requiring rotary power via a belt or the like from the engine of the vehicle. Consequently, it would be desirable to provide a refrigeration system for use in vehicular applications wherein any refrigerant that escapes to the atmosphere would not be as potentially damaging to the environment and wherein system components remain small and lightweight so as to not have adverse consequences on fuel economy.

These concerns have led to consideration of transcritical $CO_2$ systems for potential use in vehicular applications. For one, the $CO_2$ utilized as a refrigerant in such systems could be claimed from the atmosphere at the outset with the result that if it were to leak from the system in which it was used back to the atmosphere, there would be no net increase in atmospheric $CO_2$ content. Moreover, while $CO_2$ is undesirable from the standpoint of the greenhouse effect, it does not affect the ozone layer and would not cause an increase in the greenhouse effect since there would be no net increase in atmospheric $CO_2$ as a result of leakage.

Such systems, however, require the use of a suction line heat exchanger to increase the refrigerating effect of the evaporator due to thermodynamic property relationships. If not used, an unusually high mass-flow rate of $CO_2$ and correspondingly high compressor input power levels are required to meet typical loads found in automotive air conditioning systems. Through the use of a suction line heat exchanger, the $CO_2$ mass-flow rate and compressor input power may be lowered with the expectation that a reduction in the size of the system compressor may be achieved. At the same time, the addition of a suction line heat exchanger to the vehicle has the potential for increasing weight as well as to consume more of the already limited space in the engine compartment of a typical vehicle. Thus, there is real need for a highly compact suction line heat exchanger.

Heretofore, suction line heat exchangers have been utilized only in relatively large refrigeration systems where the refrigerant, including conventional Freons discharged from the evaporator must be passed as a super-heated vapor to the compressor to assure that no liquid enters the compressor. This is necessary as compressors conventionally employed in refrigeration systems are positive displacement devices. As such, if any liquid refrigerant, coexisting within gaseous refrigerant in a saturated state, were drawn into the compressor, severe damage would be likely to result.

Suction line heat exchangers avoid the difficulty by bringing relatively hot, condensed refrigerant from the outlet of the system condenser or gas cooler into heat exchange relation with the refrigerant being discharged from the evaporator at a location between the evaporator and the compressor. As a consequence, the refrigerant stream exiting the evaporator will be heated. The suction line heat exchanger is sized so that the stream ultimately passed to the compressor from the suction line heat exchanger is a superheated vapor at a temperature typically several degrees above the saturation temperature of the refrigerant at the pressure at that point in the system. Thus, no refrigerant will be in the liquid phase and the compressor will receive only a gaseous refrigerant. A typical system of this sort is shown schematically in FIG. 1.

Over the years, various counter-flow or cross-flow types of heat exchangers have been employed in any of a variety of heat exchange operations. One type of counter-flow heat exchanger employs generally concentric tubes with one heat exchange fluid flowing in the inner tube in a given direction and the other heat exchange fluid flowing in a space between the inner tube and the inner wall of the outer tube and in the opposite direction. Another type of counter-flow heat exchanger includes flexible tubing wound in a continuous length on a conduit with header fittings applied to either end.

While these constructions work well for their intended purposes, the use of concentric tubes requires headering systems which are generally labor intensive in terms of fabrication and assembly such that the product is expensive.

The present invention is directed to overcoming one or more of the above problems.

SUMMARY OF THE INVENTION

It is the principal object of the invention to provide a new and improved header construction for a heat exchanger. More specifically, it is an object of the invention to provide a header system allowing fabrication of a heat exchanger that is compact, highly efficient, and of simple construction.

An exemplary embodiment of the invention achieves the foregoing objects in a heat exchanger comprising an elongated tube structure including at least three flow conduits, each having multiple ports and with a first and third flow conduit sandwiching a second flow conduit and in heat exchange relation therewith, the second conduit being shorter than the first and third conduits and having second conduit opposite ends, at least one of the second conduit opposite ends provided with a second conduit inlet/outlet fitting. The first and third conduits each have parts extending past at least one of the second conduit opposite ends to opposite sides of and around the second conduit inlet/outlet fitting to terminate in first and third conduit opposite ends, with corresponding ones of the first and third conduit opposite ends being adjacent to one another and at least one first and third conduit inlet/outlet fitting connected to both the adjacent corresponding ones of said first and third conduit opposite ends.

In a preferred embodiment each of the conduits is formed of an individual piece of tubing having flat sidewalls, the pieces being assembled with their sidewalls in abutment and bonded together in heat exchange relation.

In a preferred embodiment the parts of the first and first and third conduits are generally concave about the at least one second conduit inlet/outlet fitting and terminate in the first and third conduit opposite ends.

In a preferred embodiment two first and third conduit inlet/outlet fittings each connect to the adjacent corresponding ones of the first and third conduit opposite ends.

Preferably the first and third conduits each have an arc shaped portion extending about the second row inlet/outlet fittings and converging with corresponding ones of the first and third conduit opposite ends, the first and third conduits being longitudinally symmetrical about the second conduit, and first and third conduit inlet/outlet fittings each connecting to the corresponding adjacent first and third conduit opposite ends thereby forming a closed loop around the second conduit.

In a preferred embodiment each end of the first, second, and third conduits connect to a one piece inlet/outlet header, the header including a first port in fluid connection with the second conduit and a second port in fluid connection with the first and third conduits.

In a preferred embodiment the one piece header has a proximal end and a distal end, the first port being located at the proximal end and the second port being located at the distal end wherein the first and third conduits each extend about the first port and converge at the second port.

In a highly preferred embodiment the second conduit is in fluid communication with an opening in a proximal end wall of the header, the first conduit is in fluid communication with an opening in a first sidewall of the header, and the third conduit is in fluid communication with an opening in a second sidewall opposite the first sidewall.

In a highly preferred embodiment the first and second sidewall each include a triangular shaped groove in which an opening is located on one face of the groove, each of the openings fluidly connecting to the second port, the first and third conduits extending generally perpendicularly to each of the openings, respectively, such that the first and third conduits divergingly extend about the first port.

DESCRIPTION OF THE PREFERRED EMBODIMENTS

The heat exchanger of the invention will be described as a suction line heat exchanger in the environment of a vapor compression refrigeration system.

However, the invention may be utilized with efficacy wherever three or more conduits are united to form a heat exchanger and is not to be limited to a suction line heat exchanger or use in a refrigeration system except insofar as expressly recited in the appended claims. With the foregoing in mind, reference is made to FIG. 1.

Figure 1:
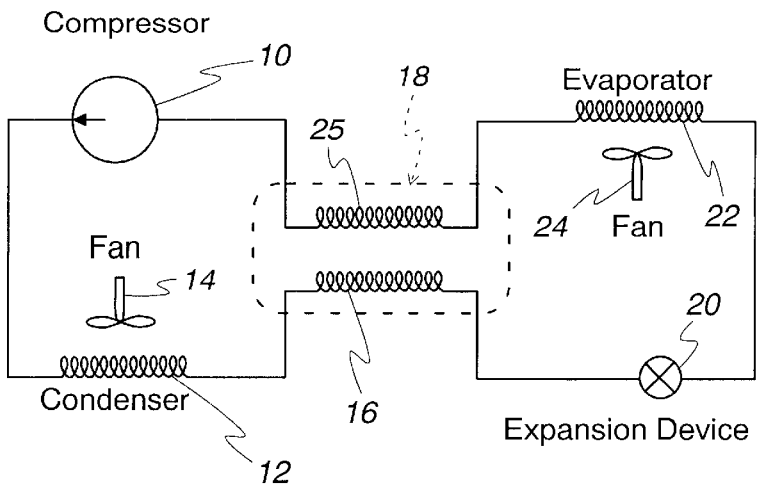
Fig. 1 (Prior art)
FIG. 1 is a schematic of atypical prior art vapor compression refrigeration system including a heat exchanger made according to the invention in the form of a suction line heat exchanger.

A conventional refrigeration system with which a heat exchanger made according to the invention may be employed as a suction line heat exchanger is illustrated in FIG. 1. The system includes a compressor 10 which receives refrigerant vapor and compresses the same for delivery to a condenser or gas cooler 12. Typically, but not always, the condenser 12 will be cooled by ambient air directed through it by a fan 14. As a result, hot, liquid refrigerant or dense gaseous refrigerant exits the condenser and is provided to one flow path 16 of a suction line heat exchanger 18 and then to an expansion device 20. If used in a transcritical refrigeration system, the refrigerant emerges from the condenser/gas cooler as a dense vapor under high pressure. In the expansion device, the refrigerant undergoes a pressure drop and is directed to a conventional evaporator 22. Typically, but not always, ambient air to be cooled will be directed through the evaporator by a fan 24. However, in some instances, the evaporator 22 may be employed to cool a liquid rather than air or gas.

Refrigerant exiting the evaporator is then passed to a flow path 25 within the suction line heat exchanger 18 where it is further heated by hot refrigerant exiting the condenser 12 and passing to the expansion device 20. To this end, the flow path 25 is in heat exchange relation to the flow path 16. The further heating is such that the refrigerant emerges the suction line heat exchanger 18 as a super heated vapor and is then fed to the inlet of the compressor 10 to be recycled.

Figure 2:
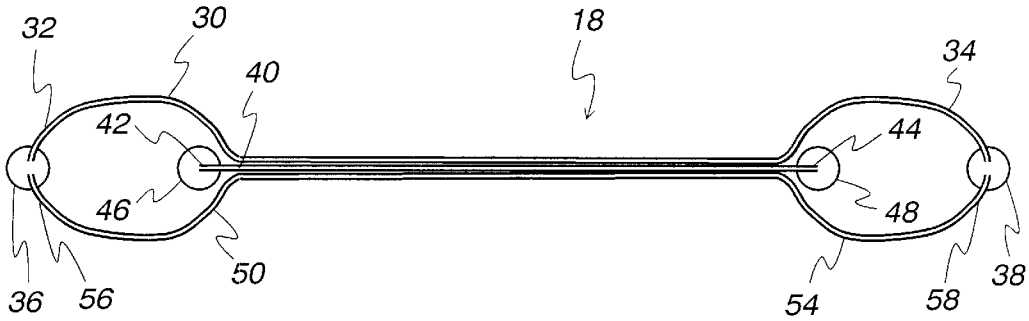
FIG. 2 is a side elevation of one embodiment of a heat exchanger made according to the invention.
Figure 3:
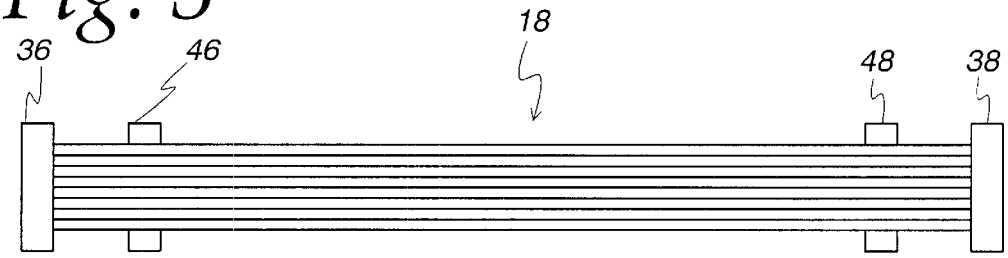
FIG. 3 is a plan view of the embodiment illustrated in FIG. 2.

Referring now to FIGS. 2 and 3, one exemplary construction of the suction line heat exchanger 18 is illustrated. The same is made up of three rows of flattened, multiport tubing. A first generally straight row of tubing 30 terminates in opposite ends 32, 34 on which are received refrigerant fittings 36 and 38 respectively. A second row of tubing 40 also includes a generally straight run abutting and in heat exchange relation with the tubing 30. The tubing 40 terminates in opposite ends 42, 44 on which are received refrigerant fittings 46 and 48 respectively. A third row of tubing 50 includes a generally straight run abutting to and in heat exchange relation with the tubing 40 so that the tubing 40 is "sandwiched" between the tubing 30 and the tubing 50. The tubing 50 is symmetrical with the tubing 30 and includes concave arc shaped parts 52,54 extending about the fittings 46, 48 and terminating in opposite ends 56, 58. The ends 56, 58 are, inturn, in fluid communication with the fittings 36,38 respectively. Thus the tubing 50 is in hydraulic parallel with the tubing 30.

Figure 4:
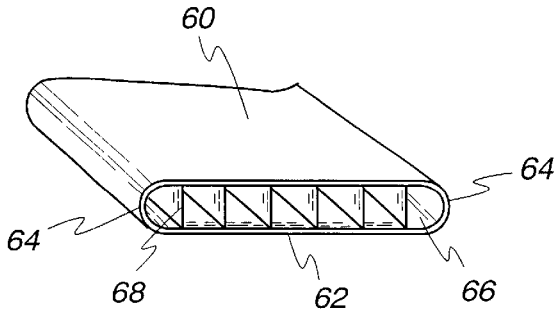
FIG. 4 is a sectional view of a multiport, flattened tube employed in the invention.

Each of the tubes 30,40,50 is a multiport tube as mentioned previously with flattened sides. A typical cross section of flattened, multiport tube is shown in FIG. 4 and will be described in greater detail herinafter.

More specifically, each of the flattened tubes 30, 40, 50 includes opposite, flat sides 60, 62 and rounded edges 64 which extend across the minor dimension of the tube. Within the tube are a plurality of ports 66 separated by webs 68. Typically, such a tube will be formed by extrusion but the same may also be formed as a so-called fabricated tube, i.e., a flattened tube with an interior insert brazed to the interior walls to define the multiple ports.

In the usual case, the ports 66 will be of relatively small hydraulic diameter, i.e., a hydraulic diameter of up to 0.07 inches. Hydraulic diameter is as conventionally defined, namely, for times the cross-sectional area of a port 66 divided by its wetted perimeter. However, tubes with ports of greater hydraulic diameter may also be used if desired.

It may be seen from FIG. 2 that the second tube 40 is abutted to and in heat exchange relationship with both the first tube 30 and the third tube 50. To further enhance heat transfer between the tubes, each of the tubes 30, 40, 50 will be braze clad so that they will be metallurgically bonded together by an assembly process involving brazing at their areas of abutment.

In some cases, only the ends 32,42, and 56 connect to the fittings 36 and 46. The opposite ends 34, 44, and 58 of the tubes 30, 40, 50 are headered by any suitable means.

Figure 5:
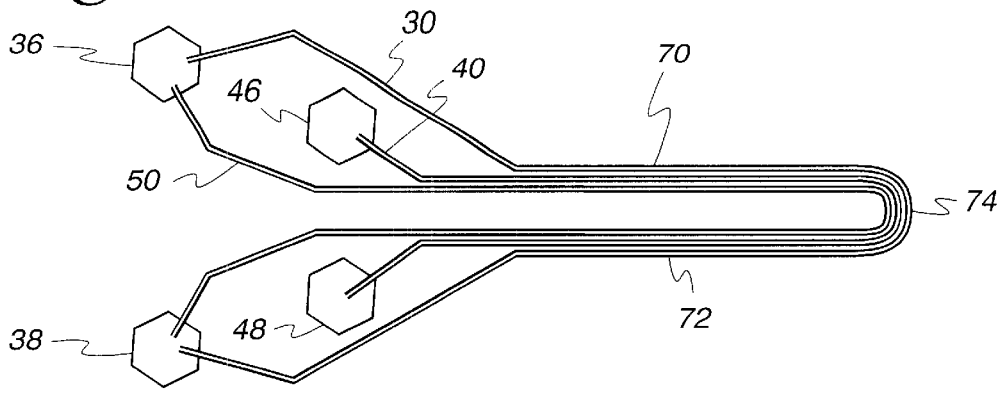
FIG. 5 is a side elevation of another embodiment of a heat exchanger made according to the invention.
Figure 6:
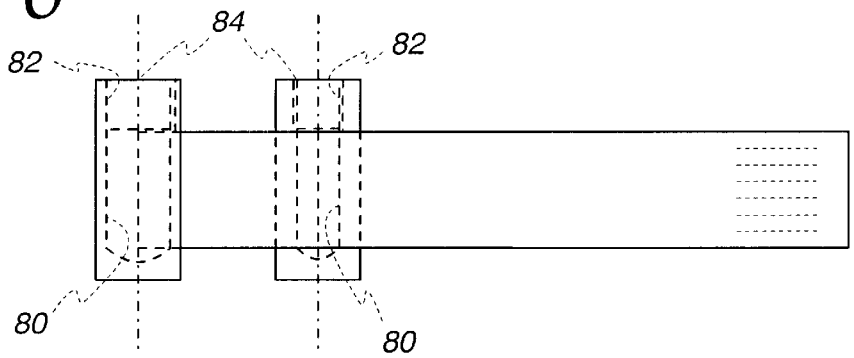
FIG. 6 is a plan view of the embodiment illustrated in FIG. 4.

Another embodiment shown in FIGS. 5 and 6 allows for compact packaging of the suction line heat exchanger. Each of the tubes 30, 40, and 50 is generally Y-shaped including a first generally straight length 70 and a second generally straight length 72 connected by a turn U-shaped turn 74. The fittings 36,38,46,48 may include interior blind bores 80 which are tapped as at 82 near their openings 84 to one side of each fitting. System conduits are, of course, attached to the fittings in a conventional fashion.

Figure 7:
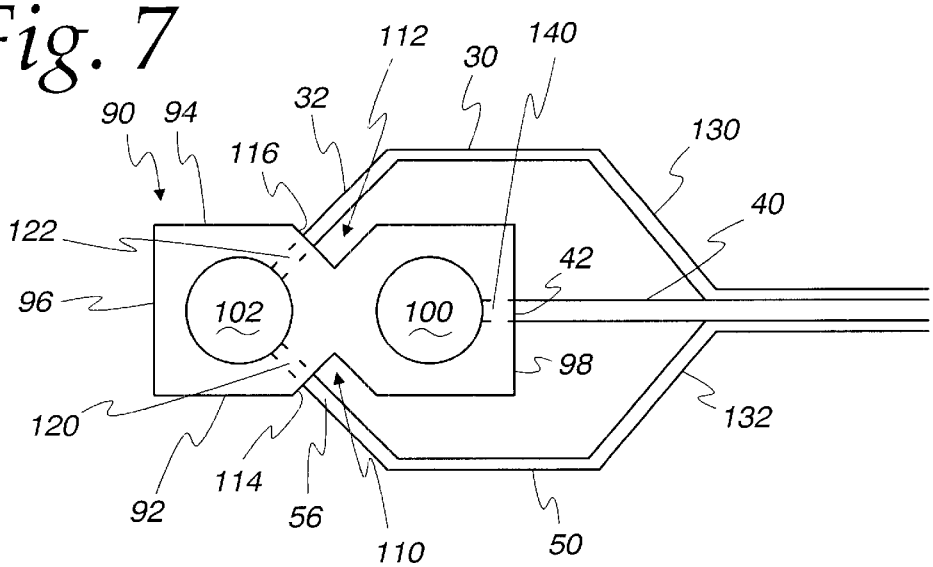
FIG. 7 is a side elevation of an alternative form of a header employed in the invention.

To further promote compactness, a one-piece header, generally designated 90, may be used as shown in FIG. 7. The header includes sides 92, 94 and ends 96,98 through which the tubes 30,40, and 50 fluidly connect to a first port 100 and a second port 102. More specifically, each of the sides 92, 94 includes a triangular shaped groove 110 and 112 respectively. A sidewall 114 and 116 of each of the grooves 110 and 112 includes an opening (not shown) connecting the ends 32, 56 to flow passages 122 and 120 so that the tubes 30, 50 (respectively) are fluidly connected to the second port 102. The ends 32, 56, of the tubes 30, 50 extend perpendicularly from the sidewalls 116 and 114 so as to extend about the first port 100. Parts 130 and 132 of the tubes 30, 50 then converge so as to abut the tube 40 for heat transfer therewith. The tube 40 connects to an opening (not shown) in the end 98 of the header 90. The opening in turn connects to a flow passage 140 fluidly connecting the tube 40 and the first port 100. The one-piece header 90 realizes greater heat transfer since heat transfer may take place within the header 90 itself.

It is to be noted that the concave ends of the tubes 30 and 50 employ continuous curves as in the embodiment of FIGS. 2 and 3 or one or two bends that are at acute angles considerably less than 90°, as for example, the approximately 45° bends shown in the embodiment of FIG. 7. This feature of the invention minimizes kinking of the tubes as well as the size of the envelope containing the ends of the tubes to assume compactness.

A simple and compact header construction for a heat exchanger is provided.

We claim:

1. A heat exchanger comprising:

an elongated tube structure including at least three rows of flow conduits, each row having multiple ports and with a first and third row sandwiching a second row and in heat exchange relation;

said second row being shorter than said first and third rows and having second row opposite ends;

at least one of said second row opposite ends provided with a second row inlet/outlet fitting;

said first and third rows each having parts extending past at least one of said second row opposite ends to opposite sides of and around said second row inlet/outlet fitting to terminate in first and third row opposite ends, with corresponding ones of said first and third row opposite ends being adjacent to one another; and at least one first and third row inlet/outlet fitting connected to the adjacent corresponding ones of said first and third row opposite ends.

2. The heat exchanger of claim 1 wherein each of said rows is formed of an individual piece of tubing having flat side walls, said pieces being assembled with their sidewalls in abutment and bonded together in heat exchange relation.

3. The heat exchanger of claim 1 wherein said parts of said first and third rows are generally concave about said second row inlet/outlet fitting and terminate in said first and third row opposite ends.

4. The heat exchanger of claim 1 wherein the second row includes a substantially straight run connecting the second row opposite ends.

5. The heat exchanger of claim 1 wherein the each of the first, second, and third row is generally Y-shaped, having a U-shaped turn connecting to generally straight diverging runs.

6. A heat exchanger comprising:

an elongated tube structure including at least three rows of flow conduits, each conduit having multiple ports and with a first and third row conduit sandwiching a second row conduit and in heat exchange relation therewith;

said second row conduit being shorter than said first and third row conduits and having second row opposite ends provided with second row inlet/outlet fittings;

said first and third row conduits each having parts extending past both said second row opposite ends to opposite sides of and around said second row inlet/outlet fittings to terminate in first and third row opposite ends, with corresponding ones of said first and third row opposite ends being adjacent to one another; and two first and third row inlet/outlet fittings, each connected to the adjacent corresponding ones of said first and third row conduit opposite ends.

7. The heat exchanger of claim 6 wherein each of said conduits is formed of an individual piece of tubing having flat side walls, said pieces being assembled with their sidewalls in abutment and bonded together in heat exchange relation.

8. The heat exchanger of claim 6 wherein said parts of said first and third row conduits are generally concave about said second row inlet/outlet fittings and terminate in first and third row opposite ends.

9. The heat exchanger of claim 6 wherein the second row conduit includes a substantially straight run connecting the second row opposite ends.

10. The heat exchanger of claim 6 wherein the each of the first, second, and third row conduits is generally Y-shaped, having a U-shaped turn connecting to generally straight diverging runs.

11. A heat exchanger comprising:

an elongated tube structure including three tubes having flattened sides and opposite open ends and aligned so as to form three rows , with a first tube and a third tube longitudinally sandwiching a second tube;

said second tube being shorter than said first and third tubes and said open ends of said second tube having inlet and outlet fittings attached thereto:

said first and third tubes being substantially the same length and abutting to and in heat transfer relation with each of said flattened sides of said second tube;

said first and third tubes each having an arc shaped portion extending about said second row inlet or outlet fittings and converging with corresponding ones of said first and third tube opposite ends;

said first and third tubes being longitudinally symmetrical about said second tube; and first and third tube inlet/outlet fittings each connecting to the corresponding adjacent first and third tube opposite ends thereby forming a closed loop around said second tube.

12. The heat exchanger of claim 11 wherein each end of said first, second, and third tubes connect to a one piece header;

said header includes a first port in fluid connection with said second tube; and said header includes a second port in fluid connection with said first and third tubes.

13. The heat exchanger of claim 12 wherein said header includes a proximal end and a distal end;

said first port being located at said proximal end of said header;

said second port being located at said distal end of said header.

14. The heat exchanger of claim 12 wherein said first and third tubes each extend about said first port and converge so as to be in fluid communication with said second port.

15. The heat exchanger of claim 13 wherein the second tube is in fluid communication with an opening in a proximal end wall of the header, the first tube is in fluid communication with an opening in a first sidewall of the header, and the third tube is in fluid communication with an opening in a second sidewall opposite the first sidewall.

16. The heat exchanger of claim 15 wherein the first and second sidewall each include a triangular shaped groove in which an opening is located on one face of the groove, each of the openings fluidly connecting to the second port, the first and third tubes extending generally perpendicularly to each of the openings, respectively, such that the first and third tubes divergingly extend about the first port.

* * * * *